US007950782B2

(12) United States Patent
Kato

(10) Patent No.: US 7,950,782 B2
(45) Date of Patent: May 31, 2011

(54) DROPLET DISCHARGING HEAD, ENERGY CONVERTER, PIEZOELECTRIC DEVICE, MEMS STRUCTURE, CANTILEVER ACTUATOR, PIEZOELECTRIC SENSOR, AND PIEZOELECTRIC LINEAR MOTOR

(75) Inventor: Jiro Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 770 days.

(21) Appl. No.: 11/960,443

(22) Filed: Dec. 19, 2007

(65) Prior Publication Data

US 2008/0151009 A1 Jun. 26, 2008

(30) Foreign Application Priority Data

Dec. 21, 2006 (JP) ..... 2006-343901
Oct. 31, 2007 (JP) ..... 2007-282888

(51) Int. Cl.
*B41J 2/045* (2006.01)

(52) U.S. Cl. ..... 347/70; 347/68

(58) Field of Classification Search ..... 347/68–72
See application file for complete search history.

(56) References Cited

U.S. PATENT DOCUMENTS 6,584,660 B1 * 7/2003 Shimogawa et al. ..... 29/25.35
2006/0181582 A1 * 8/2006 Sugahara ..... 347/70

FOREIGN PATENT DOCUMENTS

JP A-11-034360 2/1999
JP A-2005-111982 4/2005
JP A-2005-268549 9/2005

OTHER PUBLICATIONS

A. Barzegar et al.; "Piezoelectric response of thin films determined by charge integration technique: Substrate bending effects"; *Journal of Applied Physics*; vol. 93, No. 8; Apr. 15, 2003.

* cited by examiner

*Primary Examiner* — Geoffrey Mruk
(74) *Attorney, Agent, or Firm* — Workman Nydegger

(57) ABSTRACT

A droplet discharging head includes a substrate, a cavity section positioned on a first surface side of the substrate, a piezoelectric thin film positioned on a second surface side of the substrate and disposed in an area opposing the cavity section, a cover section positioned on the first surface side of the substrate, and disposed covering the cavity section, the cover section having a through-hole, and a groove positioned on the second surface side of the substrate and disposed in a direction extending along an edge of the piezoelectric thin film.

11 Claims, 10 Drawing Sheets

DROPLET DISCHARGING HEAD, ENERGY CONVERTER, PIEZOELECTRIC DEVICE, MEMS STRUCTURE, CANTILEVER ACTUATOR, PIEZOELECTRIC SENSOR, AND PIEZOELECTRIC LINEAR MOTOR

The entire disclosure of Japanese Patent Application Nos: 2006-343901, filled Dec. 21, 2006 and 2007-282888, filed Oct. 31, 2007 are expressly incorporated by reference herein.

BACKGROUND

1. Technical Field

The present invention relates to a droplet discharging head, an energy converter, a piezoelectric device, a micro-electric mechanical system (MEMS) structure, a cantilever actuator, a piezoelectric sensor, and a piezoelectric linear motor.

2. Related Art

To enhance a resolution of printed matter outputted from an ink-jet printer and to increase printing speed, advance is being made in densification to heighten a mounting density of a droplet discharging head. Application of the droplet discharging head in fields other than printing is being discussed. Thus, further integration of the droplet discharging head is required. To improve the integration of the droplet discharging head, for example, as described in JP-A-2005-111982 and JP-A-11-34360, a technology is proposed in which the mounting density of the droplet discharging head is heightened by improvements made in the design of a droplet discharging head configuration. In addition, as described in JP-A-2005-268549, a technology is proposed in which the orientation and the particle size of a piezoelectric thin film are controlled to form a finer piezoelectric thin film.

An ink-jet head using Coulomb force as a driving force, implementation of which can be seen in recent years, an ultrasonic motor using a piezoelectric element, and the like are being developed. Not only devices driven by a supply of electric power, but also pressure sensors and the like that output deformation caused by stress in the form of voltage (because electrical resistance is high, detection is performed using voltage instead of current) are becoming popular. An energy converter that uses the correlation between deformation and voltage (electric power) in this way is known. Some energy converters perform conversion using deformation as input energy and voltage (electric power) as output energy. Alternatively, some energy converters perform conversion using voltage (electric power) as the input energy and deformation as the output energy. Not only the ink-jet head, but also, for example, a piezoelectric device that can control an amount of displacement in correspondence with an applied voltage (electric power), a MEMS structure having a movable section, and the like have been paid attention.

JA-2005-1119852 is a first example of a related art. JA-11-34360 is second example of a related art. JA-2005-268549 is a third example of a related art. J. Appl. Phys. 93 4756 (2003) is a fourth example of a related art.

When the technologies propose in the first example and second example are used, a printer head integrating a plurality of droplet discharging heads becomes larger and heavier. Because of the increase in weight, moving the printer head with speed and accuracy becomes difficult. Printing speed and printing quality deteriorate. Manufacturing cost of the printer head that has become larger increases, becoming disadvantageous in terms of cost.

When the technology proposed in the third example is used, as described in the fourth example, shear stress concentrated on an edge of the piezoelectric thin film increases with size reduction. Life characteristics of the droplet discharging head deteriorate.

Regarding the energy converter, the piezoelectric device, and the MEMS structure having the movable section, as well, the shear stress concentrated on an edge of the energy converter, on an edge of the piezoelectric thin film in the piezoelectric device, and on an edge of the movable section of the MEMS structure also increases. The life characteristics of the energy converter, the piezoelectric device, and the MEMS structure having the movable section deteriorate,

SUMMARY

In the invention, "up" refers to a direction from a first surface of a substrate towards a side opposing a second surface. "Upper side" refers to a direction from the side opposing the second surface of the substrate towards the first surface of the substrate.

An advantage of the invention is to provide a droplet discharging head, an energy converter, a piezoelectric device, a micro-electric mechanical system (MEMS) structure, a cantilever actuator, a piezoelectric sensor, and a piezoelectric linear motor.

A droplet discharging head according to a first aspect of the invention includes a substrate, a cavity section, a piezoelectric thin film, a cover section, and a groove. The cavity section is positioned on a first surface side of the substrate. The piezoelectric thin film is positioned on a second surface side of the substrate and disposed in an area opposing the cavity section. The cover section is positioned on the first surface side of the substrate. The cover section has a through-hole and is disposed covering the cavity section. The groove is positioned on the second surface side of the substrate and disposed in a direction running along an edge of the piezoelectric thin film.

According to the first aspect, when voltage (electric power) is applied to the piezoelectric thin film and the piezoelectric thin film is compressed and expanded, because the groove is provided in the direction extending along the edge of the piezoelectric thin film, stress accompanying the compression and the expansion of the piezoelectric thin film, particularly shear stress, is alleviated by deformation of the groove. As a result, an ink-jet (droplet discharging) head having superior life characteristics can be provided.

In the droplet discharging head of the first aspect, when a distance between an edge of the piezoelectric thin film at a side adjacent to the groove and an edge of the groove at a side adjacent to the piezoelectric thin film is x (micrometer unit) and a depth of the groove is d (micrometer unit), the groove may satisfy, $0.2d(-4.6x+42.8) \geqq 1$ (Relational Expression 1).

The Relational Expression 1 is derived under the premise that shear stress applied to a material is even in the depth direction on the order of microns and a processing depth and piezoelectric performance are proportional, and by a value obtained from an experiment being assigned to the expression. The Relational Expression 1 indicates conditions under which the piezoelectric performance (amount of displacement/applied voltage [electric power]) improves by 1% or more.

Accordingly, a droplet discharging head that can detect a significant amount of alleviation of the shear stress applied to the piezoelectric thin film can be provided.

In the droplet discharging head of the first aspect, when a distance between an edge of the piezoelectric thin film at a side adjacent to the groove and an edge of the groove at a side adjacent to the piezoelectric thin film is x (micrometer unit)

and a depth of the groove is d (micrometer unit), the groove may satisfy $0.2d(-4.6x+42.8) \geqq 5$ (Relational Expression 2).

The Relational Expression 2 indicates conditions under which the piezoelectric performance (amount of displacement/applied voltage [electric power]) improves by 5% or more. According to the third aspect, a droplet discharging head of which the life characteristics can be significantly improved by the alleviation of the shear stress applied to the piezoelectric thin film can be provided.

In the droplet discharging head according to the first aspect, the distance between the edge of the piezoelectric thin film at a side adjacent to the groove and the edge of the groove at a side adjacent to the piezoelectric thin film may be 1 micrometer or more.

Accordingly, influence on the piezoelectric thin film is suppressed and shear stress is alleviated. As a result, a droplet discharging head having superior life characteristics can be provided.

In the droplet discharging head according to the first aspect, the groove may be formed and have a depth of 10 micrometers or less.

Accordingly, a droplet discharging head including a groove that can achieve alleviation of shear stress, in a state in which mechanical strength of the droplet discharging head is maintained, is provided.

In the droplet discharging head according to the first aspect, a filler material having a lower Young's modulus than the substrate may be disposed within the groove.

Accordingly, the interior of the groove is sealed. Permeation of particle-shaped materials and gases smaller than the width of the groove can be suppressed. Because Young's modulus is low, operation of the piezoelectric thin film is not inhibited. Mechanical and chemical deterioration does not easily occur A highly reliable droplet discharging head can be provided.

In the droplet discharging head according to the first aspect, the substrate may include silicon.

A processing procedure for achieving a micro-structure is being studied. Through use of a substrate including silicon having a proven track record, an ink-jet head processed with high accuracy can be provided.

In the droplet discharging head according to the first aspect, the filler material may be porous silicon oxide.

The porous silicon oxide is a highly reliable material having a low Young's modulus. Therefore, compared to when the groove is filled with another material, a more highly reliable droplet discharging head can be provided.

In the droplet discharging head according to the first aspect, the cavity section may include a through-hole section and a movable plate. The through-hole section penetrates the substrate. The movable plate is positioned on the second surface side of the substrate and covers the through-hole section.

Accordingly, a material separate from the substrate can be used for the movable plate. As a result, the movable plate can be configured using a preferable material selected depending on the intended use of the droplet discharging head.

In the droplet discharging head according to the first aspect, the cavity section may use a portion of the substrate as the movable plate.

According to the first aspect, a portion of the substrate is used as the movable plate. Therefore, the movable plate and the substrate can be integrally formed. As a result, a seamless movable plate having superior reliability can be achieved.

A droplet discharging head according to a second aspect of the invention includes a substrate, a cavity section, a cover material, a movable plate, a material pressing body, and a groove or a recess section. The cavity section is formed on the substrate. The cover material is disposed on a first surface side of the substrate and has a discharge opening for discharging a fluid within the cavity section. The movable plate is disposed on a second surface side of the substrate. The material pressing body is in contact with the movable plate and includes a piezoelectric thin film sandwiched between a first electrode and a second electrode. The groove or the recess section is provided on the second surface side of the substrate.

According to the second aspect, when voltage (electric power) is applied to the piezoelectric thin film and the piezoelectric thin film is compressed and expanded, because the groove or the recess section is provided in the direction extending along the edge of the piezoelectric thin film, stress accompanying the compression and the expansion of the piezoelectric thin film, particularly shear stress, is alleviated by deformation of the groove or the recess section. As a result, an ink-jet (droplet discharging) head having superior life characteristics can be provided. The recess sections can be individually formed. Alternatively, the recess sections can be connected.

An energy converting element according to a third aspect of the invention includes a substrate, a flexible section, an energy converting section, and at least one of either a groove or a recess section. The flexible section is disposed on a first surface side of the substrate. The energy converting section converts electric power to bending of the flexible section or converts bending of the flexible section to electric power. The groove or the recess section is disposed on a first surface side of the substrate, along an edge of the energy converting section.

According to the third aspect, when voltage (electric power) is applied to the energy converting section and the energy converting section is compressed and expanded, because the groove or the recess section is provided in the direction extending along the edge of the energy converting section, stress accompanying the compression and the expansion of the energy converting section, particularly shear stress, is alleviated by deformation of the groove or the recess section. As a result, an energy converting element having superior life characteristics can be provided. The recess sections can be individually formed. Alternatively, the recess sections can be connected.

In the energy converting element according to the third aspect, when a distance between an edge of the energy converting section at a side adjacent to the groove or the recess section and an edge of the groove or the recess section at a side adjacent to the energy converting section is x (micrometer unit) and a depth of the groove or the recess section is d (micrometer unit), the groove or the recess section may satisfy $0.2d(-4.6x+42.8) \geqq 1$ (Relational Expression 4).

The Relational Expression 4 is derived under the premise that shear stress applied to a material is even in the depth direction on the order of microns and a processing depth and piezoelectric performance are proportional, and by a value obtained from an experiment being assigned to the expression. The Relational Expression 4 indicates conditions under which the piezoelectric performance (amount of displacement/applied voltage [electrical power]) improves by 1% or more.

Accordingly, an energy converting element that can detect a significant amount of alleviation of the shear stress applied to the energy converting section can be provided.

In the energy converting element according to the third aspect, when a distance between an edge of the energy converting section at a side adjacent to the groove or the recess section and an edge of the groove or the recess section at a side adjacent to the energy converting section is x (micrometer unit) and a depth of the groove or the recess section is d (micrometer unit), the groove or the recess section may satisfy $0.2d(-4.6x+42.8) \geqq 5$ (Relational Expression 5).

The Relational Expression 5 indicates conditions under which the piezoelectric performance (amount of displacement/applied voltage [electric power]) improves by 5% or more.

Accordingly, an energy converting element of which the life characteristics can be significantly improved by the alleviation of the shear stress applied to the energy converting section can be provided.

In the energy converting element according to the third aspect, the distance between the edge of the energy converting section at a side adjacent to the groove or the recess section and the edge of the groove or the recess section at a side adjacent to the energy converting section may be 1 micrometer or more.

Accordingly, influence on the energy converting section is suppressed and shear stress is alleviated. As a result, an energy converting element having superior life characteristics can be provided.

In the energy converting element according to the third aspect of the invention, the groove or the recess section may be formed and have a depth of 10 micrometers or less.

Accordingly, an energy converting element including a groove or a recess section that can achieve alleviation of shear stress, in a state in which mechanical strength of the energy converting element is maintained, is provided.

In the energy converting element according to the third aspect, a filler material having a lower Young's modulus than the substrate may be disposed within the groove or the recess section.

Accordingly, the interior of the groove or the recess section is sealed. Permeation of particle-shaped materials and gases smaller than the width of the groove or the recess section can be suppressed. Because Young's modulus is low, operation of the energy converting section is not inhibited. Mechanical and chemical deterioration does not easily occur. A highly reliable energy converting element can be provided.

In the energy converting element according to the third aspect, the substrate may include silicon.

A processing procedure for achieving a micro-structure is being studied. Through use of a substrate including silicon having a proven track record, an energy converting element processed with high accuracy can be provided.

In the energy converting element according to the third aspect, the filler material may be porous silicon oxide.

The porous silicon oxide is a highly reliable material having a low Young's modulus. Therefore, compared to when the groove is filled with another material, a more highly reliable energy converting element can be provided.

A piezoelectric device according to a fourth aspect of the invention includes a substrate, a piezoelectric thin film, a first electrode and a second electrode, and at least one of either a groove or a recess section. The piezoelectric thin film is disposed on a first surface side of the substrate. The first electrode and the second electrode are in contact with the piezoelectric thin film. The groove or the recess section is provided on the first surface side of the substrate, along an edge of the piezoelectric thin film.

According to the fourth aspect, when voltage (electric power) is applied to the piezoelectric thin film by the first electrode and the second electrode and the piezoelectric thin film is compressed and expanded, because the groove or the recess section is provided in the direction running along the edge of the piezoelectric thin film, stress accompanying the compression and the expansion of the piezoelectric thin film, particularly shear stress, is alleviated by deformation of the groove or the recess section. As a result, a piezoelectric device having superior life characteristics can be provided. The recess sections can be individually formed. Alternatively, the recess sections can be connected.

A MEMS structure according to a fifth aspect of the invention includes a substrate, a movable section, and at least one of either a groove or a recess section. The movable section is provided on the substrate. The groove or the recess section is provided on the substrate, along an edge of the movable section.

According to the fifth aspect, when the movable section is deformed, because the groove or the recess section is provided in the direction running along the edge, stress accompanying the deformation of the movable section is alleviated by deformation of the groove or the recess section. As a result, a MEMS structure having superior life characteristics can be provided. The recess sections can be individually formed. Alternatively, the recess sections can be connected.

A cantilever actuator according to a sixth aspect of the invention uses the above-described energy converting element, the piezoelectric device, or the MEMS structure.

According to the sixth aspect, stress applied to the piezoelectric thin film is released by deformation of the groove or the recess section. As a result, damage caused by stress can be suppressed, and service life can be extended.

A piezoelectric sensor according to a seventh aspect of the invention uses the above-described energy converting element, the piezoelectric device, or the MEMS structure.

According to the seventh aspect, the piezoelectric thin film can be significantly distorted by a small amount of stress, because of deformation of the groove or the recess section. As a result, a highly sensitive piezoelectric sensor can be provided.

A piezoelectric linear motor according to an eighth aspect of the invention uses the above-described energy converting element, the piezoelectric device, or the MEMS structure.

According to the eighth aspect, stress applied to the piezoelectric thin film is released by deformation of the groove or the recess section. Therefore, an amount of deformation by the same voltage (electric power) can be increased compared to related arts. As a result, a piezoelectric linear motor with a high operation speed can be provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the present invention will be described.

Figure 1A:
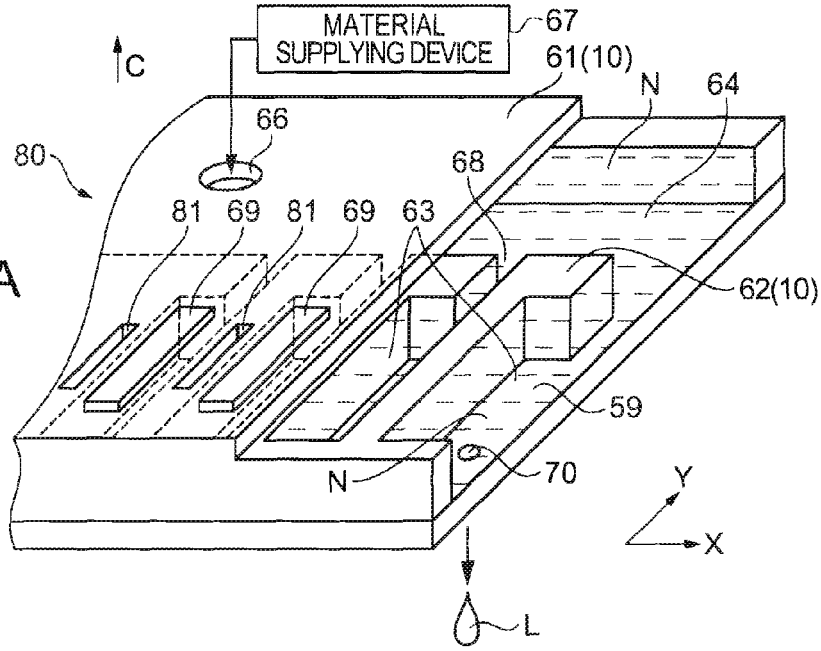
FIG. 1A is a perspective view of a printer head integrating a droplet discharging head.
Figure 1B:
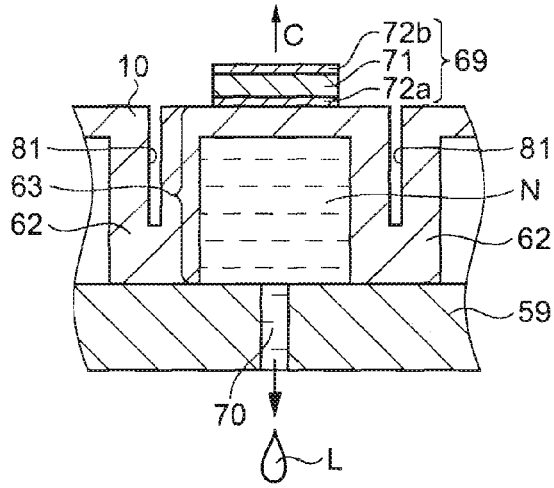
FIG. 1B is a cross-sectional view of the vicinity of a discharge opening on the droplet discharging head shown in FIG. 1A.
Figure 1C:
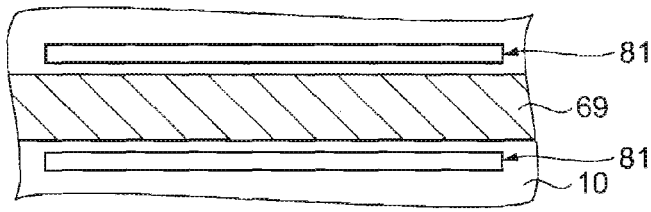
FIG. 1C is a partial plan view of the droplet discharging head.

A configuration of a droplet discharging head will be described below, with reference to the drawings. FIG. 1A is a perspective view of a printer head integrating a droplet discharging head. FIG. 1B is a cross-sectional view of the vicinity of a discharge opening on the droplet discharging head shown in FIG. 1A. FIG. 1C is a partial plan view of the droplet discharging head viewed from an upper side.

As shown in FIG. 1A, a partitioning component 62 and a movable plate 61 are formed on a substrate 10. The substrate 10 is not formed using silicon. A material pressing body 69 is disposed on a C side (a second surface side) of the substrate 10. Instead of a present configuration in which a portion of the substrate 10 is used as the partitioning component 62, silicon oxide, zirconium oxide, tantalum oxide, silicon nitride, aluminum oxide, and the like can be used as a constituent material of the partitioning component 62. As shown in FIG. 1B, the material pressing body 69, formed on the C side of the substrate 10 (the second surface side), includes an electrode 72*a*, a piezoelectric thin film 71, and an electrode 72*b*.

When the material of the movable plate 61 is changed, a thin film can be formed on the C side of the substrate 10 using, for example, a sputtering method or a chemical vapor deposition method. The thin film includes silicon oxide, zirconium oxide, tantalum oxide, silicon nitride, aluminum oxide, and the like. A surface of the substrate on a side (a first surface side) opposite of the C side can be etched, leaving the thin film. When silicon oxide is used as the material for the movable plate 61 and silicon is used for the substrate 10, when the substrate 10 undergoes thermal oxidation and silicon oxide is formed, a dense silicon oxide can be obtained. Therefore, the movable plate 61 is preferably silicon oxide. A printer head 80 can also be formed by the substrate 10 being etched such that an area corresponding to a cavity 63 is penetrated and the substrate 10 and the movable plate 61 being bonded.

A cover material 59 is formed on the surface of the substrate 10, on the side opposite of the C side, thereby forming a cavity 63. The cover material 59 includes a discharge opening 70. The cover material 59 is fixed to the substrate 10 by, for example, an adhesive agent or a heat-sealing film.

Ink in colors such as cyan, magenta, and yellow, is used as a fluid N. When an electrode or the like is formed using the printer head 80, metal particles and metal ions, a wiring material fluid, a semiconductor material fluid including a silicon compound, a material fluid including an insulating material or a piezoelectric material, and the like can be used in place of the colored ink. The wiring material fluid uses an agent including metal components, such as metal complex. A material liquid dispersed with microparticles of a size capable of passing through the discharge opening 70 can also be used.

The electrode 72*a* is sandwiched between the piezoelectric thin film 71 and the movable plate 61. A metal that adversely affects neither the piezoelectric thin film 71 nor the movable plate 61 is preferably used for the electrode 72*a*. Preferably, a laminated structure of iridium (Ir)/platinum (Pt), Pt/Ir, Ir/Pt/Ir, and the like, or an alloy of Ir and Pt is used. The material used for the electrode 72*b*, covering the piezoelectric thin film 71, is not particularly limited, as long as the electrode 72*b* is made of a conductive material that can be used as an ordinary electrode. The electrode 72*b* can be, for example, a single-layer film, such as Pt, $RuO_2$, Ir, $IrO_2$, and the like. Alternatively, the electrode 72*b* can be a laminated film including two or more layers, such as Pt/Ti/, Pt/Ti/TiN, Pt/TiN/Pt, Ti/Pt/Ti, TiN/Pt/TiN, Pt/Ti/TiN/Ti, $RuO_2$/TiN, $IrO_2$/Ir, $IrO_2$/TiN, and the like (a multilayer structure using "/" is indicated as "top layer/(middle layer)/bottom layer").

When voltage (electric power) is applied to the electrode 72*a* and the electrode 72*b* of the material pressing body 69, the material pressing body 69 becomes deformed and shrinks in a direction parallel with the surface. The movable plate 61 becomes deformed and projects in a direction reducing the volume of the cavity 63. As a result of the deformations, the fluid N, such as the colored ink, positioned within the cavity 63, described above, is discharged from the discharge opening 70 towards a subject to be printed, as a droplet L. After the droplet L is discharged and the supply of voltage (electric power) applied to the electrode 72*a* and the electrode 72*b* is stopped, the material pressing body 69 returns to its original shape. The fluid N passes from a material supplying device 67 and through a material supplying hole 66. The fluid N is supplied to the cavity 63, and the printer head 80 returns to a state prior to the discharge of the droplet L.

The piezoelectric thin film 71 is made from, for example, Pb:Ti:O(PT), Pb:Zr:O(PZ), Pb:(Zr:Ti):O, Pb:(Mg:Nb):O—Pb:Ti:o(PMN-PT), Pb:Zn:Ti:Nb:O(PZTN[registered trademark]), Pb:(Ni:Nb):O—Pb:Ti:O(PNN-PT), Pb:(In:Nb):O—Pb:Ti:O(PIN-PT), Pb:(Sc:Ta):O—Pb:Ti:O(PST-PT), Pb:(Sc:Nb):O—Pb:Ti:O(PSN-PT), Bi:Sc:O—Pb:Ti:O(BS-PT), Bi:Yb:O—Pb:Ti:O(BY-PT), Sr:Sm:Bi:Ta:O(SSBT), Ba:Pb:O, Ba:Ti:O(BT), Sr:Bi:Nb:Ta:O(SBNT), Ba:Sr:Ti(BST), Bi:Ti:O(BIT), Bi:La:Ti:O(BLT), and Sr:Ba:Ti:Nb(SBTN). All of the materials above are ceramic and are brittle. Therefore, a reduction of stress, particularly of shear stress that is not involved with the discharge of the droplet, is effective for enhancing the reliability of the piezoelectric thin film 71. According to the embodiment, lead zirconium titanate is used. Lead zirconium titanate has a high electromechanical conversion rate.

A groove 81 is not disposed in the related arts. Therefore, the release of stress, particularly shear stress, is insufficient. As a result, malfunction attributed to stress may occur. Formation of the groove 81 in the invention according to the embodiment is a significant characteristic of the invention.

When the material pressing body 69 shrinks and becomes deformed, stress is applied within the material pressing body 69. As a result of the material pressing body 69 becoming deformed, the stress, particularly the shear stress, placed on the material pressing body 69 in a longitudinal direction (direction Y) is released. To release the shear stress placed in a direction (direction X) perpendicular to the longitudinal direction, the groove 81 is disposed in a direction running along an edge of the material pressing body 69. Here, rather than the interior of the groove 81 being a void, a material having a lower Young's modulus than the substrate 10 can be used. For example, a porous silicon oxide can bee used.

Next, changes in piezoelectric performance corresponding to an amount of alleviation of shear stress achieved by the disposal of the groove 81 will be explained. When the groove 81 is disposed 3 micrometers away from the edge of the material pressing body 69 including the piezoelectric thin film 71 and has a depth of 5 micrometers, the piezoelectric performance that is an amount of deformation relative to an applied voltage (electric power) improves by 29%, compared to when the groove 81 is not provided (related arts). The piezoelectric performance improves by 6% when the groove 81 is positioned 8 micrometers away from the edge of the piezoelectric thin film 71. The improvement in the piezoelectric performance of the piezoelectric thin film 71 indicates that the deformation of the piezoelectric thin film 71 is being efficiently performed. The improvement corresponds with an amount of reduction in null stress, such as the shear stress, that does not contribute to the droplet discharge by the piezoelectric thin film 71.

Based on the experiment result, when a distance from an edge of the piezoelectric thin film 71 at a side adjacent to the groove 81 to the edge of the groove 81 at aside adjacent to the piezoelectric thin film 71 is x (micrometers), and the depth of the groove 81 is d (micrometers), a Relational Expression 3 can be derived, under the premise that the shear stress applied to the substrate 10 is even in the depth direction on the order of microns and the processing depth and the piezoelectric performance are proportional. The value obtained through the experiment is assigned, and the amount of improvement in the piezoelectric performance is δ(%).

$$0.2d(-4.6x+42.8)=\delta \quad \text{(Relational Expression 3)}$$

When the amount of improvement in the piezoelectric performance (δ) is about 1%, the amount of improvemnent in the pie zoelectric performance can be detected with significant difference. As a result of the improvement in the piezoelectric performance, the amount of discharge relative to the same applied voltage (electric power) improves. Therefore, the discharge operation can be performed with less power. When $\delta \geqq 1$ is assigned in the Relational Expression 3, Relational Expression 1 can be derived.

$$0.2d(-4.6x+42.8) \geqq 1 \quad \text{(Relational Expression 1)}$$

When the improvement in the piezoelectric performance is about 5%, the amount of alleviation of the shear stress increases. The improvement in service life can be detected with significant difference. The invention becomes more preferable. When $\delta \geqq 5$ is assigned in the Relational Expression 3, Relational Expression 2 can be derived.

$$0.2d(-4.6x+42.8) \geqq 5 \quad \text{(Relational Expression 2)}$$

Regarding a positional relationship between the groove 81 and the piezoelectric thin film 71, when the groove 81 is formed using a combination of a photolithographic procedure and an etching procedure, malfunction caused by the photolithographic procedure can be suppressed by the groove 81 being separated from the piezoelectric thin film 71 by a certain distance. Specifically, manufacture and operation of the piezoelectric thin film 71 can be stabilized by the distance between the edge of the piezoelectric thin film 71 at a side adjacent to the groove 81 and the edge of the groove 81 at a side adjacent to the piezoelectric thin film 71 being maintained at 1 micrometer or more.

Figure 2:
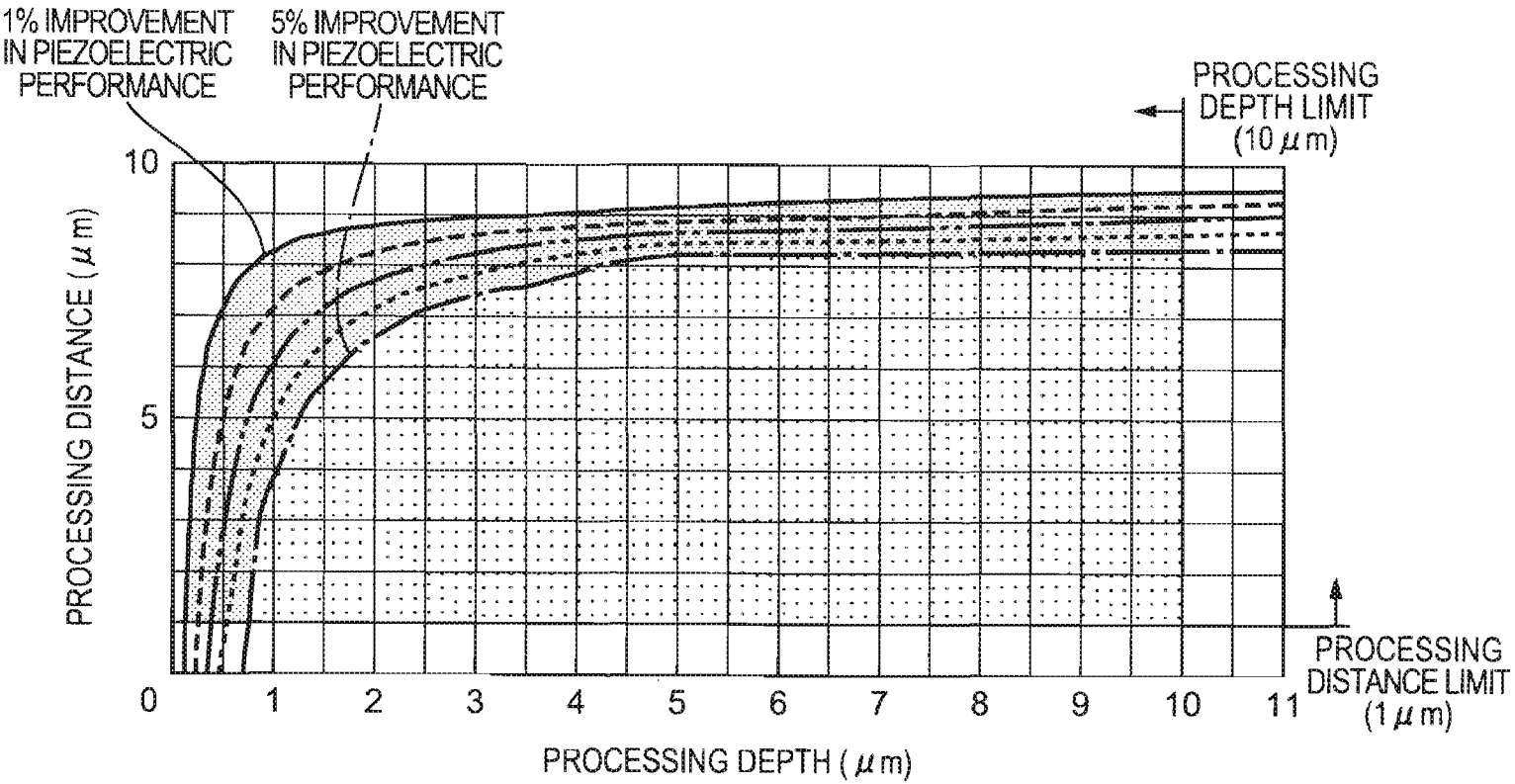
FIG. 2 is a graph showing a relationship between groove depth, position, and improvement in piezoelectric performance, with the amount of improvement in the piezoelectric performance serving as a parameter.

The groove 81 is preferably configured to have a depth allowing strength to support the stress applied by the piezoelectric thin film 71. The groove 81 is also preferably configured to facilitate processing. Specifically, the depth of the groove 81 is preferably 10 micrometers or less. Ranges meeting the above-described conditions are shown in FIG. 2 with a processing depth of the groove 81 as a horizontal axis, a processing distance between the edge of the piezoelectric thin film 71 at a side adjacent to the groove 81 and the edge of the groove 81 at a side adjacent to the piezoelectric thin film 71 as a vertical axis, and using the amount of improvement in piezoelectric performance as the parameters.

As a result of the groove 81, such as that described above, being disposed, the cavity 63 can be elastically deformed. As a result of the elastic deformation of the cavity 63, the shear stress applied to the piezoelectric thin film 71 used in the material pressing body 69 is alleviated. Therefore, the service life of the piezoelectric thin film 71 can be extended, and a highly reliable droplet discharging head can be achieved. The cavity 63 can be elastically deformed in the X direction. The shear stress is divided into tensile stress and compression stress. Therefore, compared to conventional configurations, fluctuations in a volume of a pressure chamber can be increased. As a result, a range in the amount of droplets that can be discharged at a single discharge can be widened. Printing speed can be increased without reduction in quality.

The groove 81 having a rectangular cross-section is formed according to the embodiment. However, a shape, such as a tapered shape, allowing the alleviation of the shear stress can also be used.

A C surface (a configuration in which corners are tapered) or an angle R (a configuration in which the corners are circular) can be used as the cross-sectional shape of the groove 81.

A recess can also be used instead of the groove 81. In this case, each recess can be individually formed. Alternatively, the recesses can be connected. Furthermore, both the groove 81 and the recess can be combined, such as the groove 81 being disposed in one section and the recess being disposed in the remaining sections.

According to the embodiment, a silicon substrate is used as the substrate 10. However, another material can be used instead. For example, a substrate formed from Ni by electroforming can also be used.

VARIATION EXAMPLE

Example of Groove Configuration

Figure 3A:
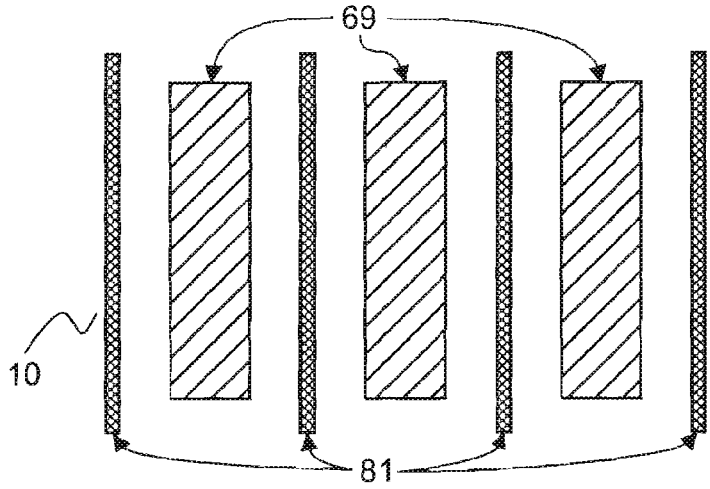
FIG. 3A to FIG. 3C are plan views of examples of groove disposal.

A variation example of the disposal of the groove 81 included in the configuration of the above-described droplet discharging head will be described below, with reference to the drawings. Rather than the groove 81 that is shorter than the material pressing body 69 being disposed as shown in FIG. 1C, the groove 81 can be longer than the material pressing body 69 as shown in FIG. 3A. As a result of this configuration, stress placed on the material pressing body 69 can be reduced, compared to the configuration in which the groove 81 is disposed as shown in FIG. 1C. Furthermore, the stress can effectively contribute to the deformation of the substrate 10. Therefore, a printer head 80 having high energy efficiency can be provided.

Figure 3B:
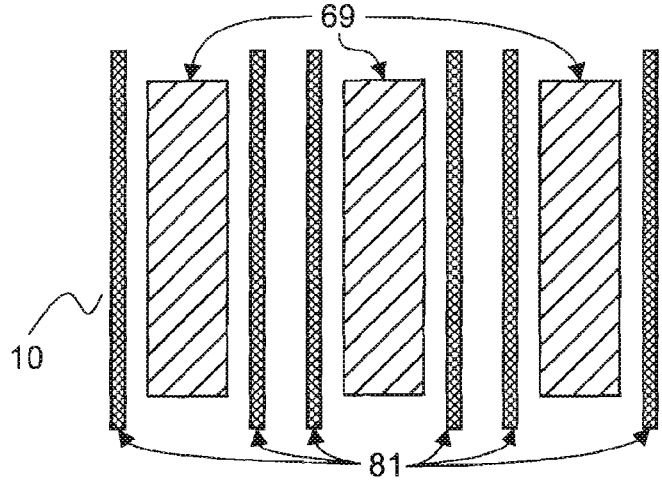

As shown in FIG. 3B, a pair of grooves 81 can be disposed for each material pressing body 69. In this case, a single material pressing body 69 can be provided with dedicated grooves 81. Influence from an adjacent material pressing body 69 can be effectively eliminated. Crosstalk occurring, when the material pressing body 69 is driven can be effectively suppressed. In this case as well, the grooves 81 can be longer than the material pressing body 69 as shown in FIG. 3B. In addition, as described above, the stress can effectively contribute to the deformation of the substrate 10. The groove 81 can also be shorter than the material pressing body 69. In this case as well, the crosstalk occurring when the material pressing body 69 is driven can be suppressed.

Figure 3C:
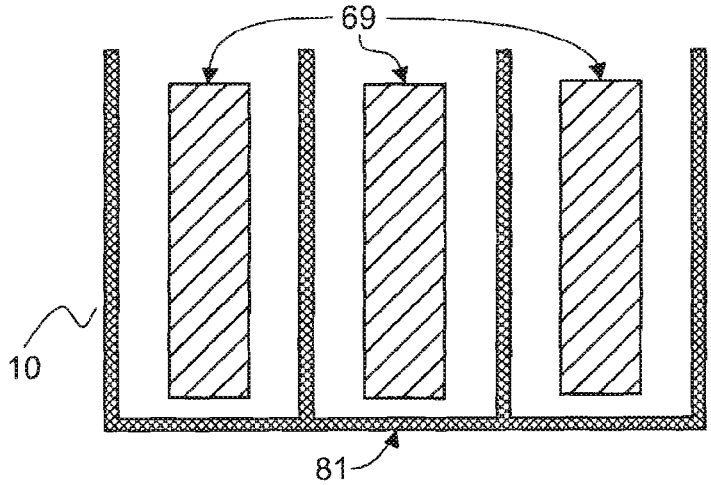

As shown in FIG. 3C, the groove 81 can be formed on the short end side of the material pressing body 69, in addition to the long end side. In this case, the stress can be more effectively alleviated. The amount of deformation corresponding to the voltage (electric power) can be increased as well. Therefore, the droplet discharging head is driven with less energy and has a longer service life. The grooves 81 on the long end side and the short end side can be disposed in positions that are separated from each other.

Figure 4A:
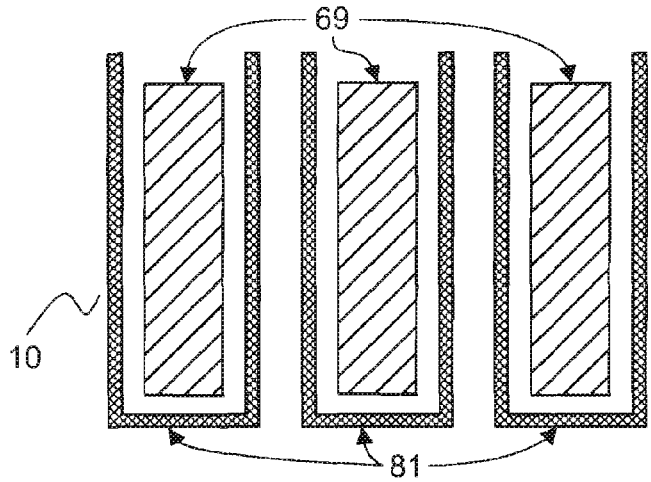
FIG. 4A to FIG. 4C are plan views of examples of groove disposal.

As shown in FIG. 4*a*, a pair of grooves 81 can be disposed for each material pressing body 69. The grooves 81 can also be formed on the short end side. In this case, in addition to the alleviation of stress at the short end side of the material pressing body 69, crosstalk accompanying the displacement of the adjacent material pressing body 69 can be suppressed. In this case as well, the grooves 81 on the short end side and the long end side can be disposed in positions separated from each other.

Figure 4B:
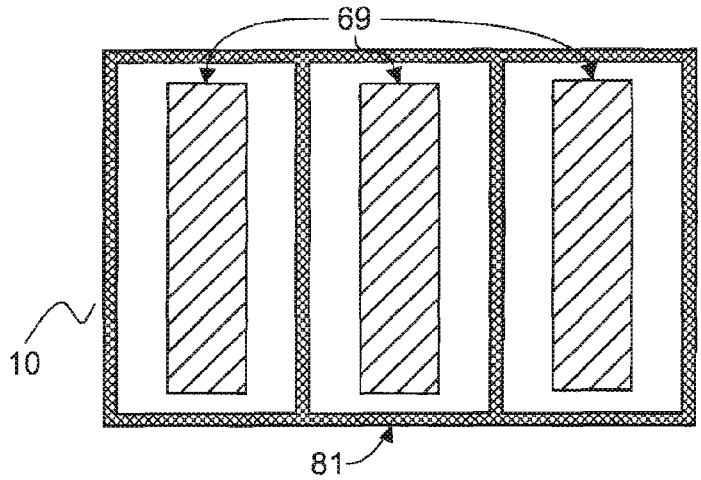

As shown in FIG. 4B, the material pressing body 69 can be surrounded by the grooves 81. In this case, the stress can be more effectively alleviated. The voltage (electric power) can be applied to the material pressing body 69 by use of a means such as wire bonding.

Figure 4C:
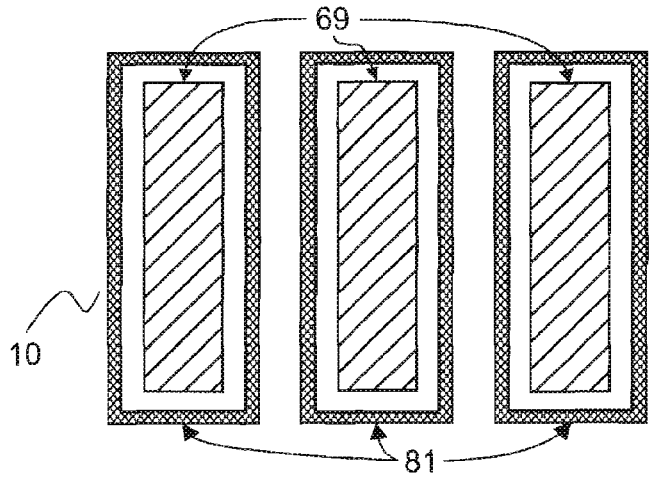

As shown in FIG. 4C, a pair of grooves 8S can be disposed for each material pressing body 69. The grooves 81 can also surround the material pressing body 69. In this case, in addition to the above-described effects, the influence from the adjacent material pressing body 69 can be more effectively eliminated.

Figure 5A:
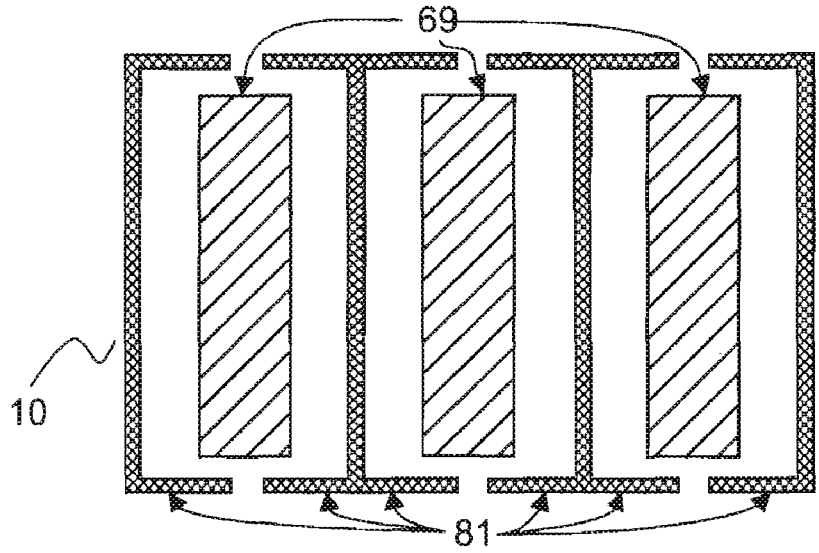
FIG. 5A and FIG. 5B are plan views of examples of groove disposal.

As shown in FIG. 5A, an area in which the groove 81 is not provided can be disposed in a portion of the groove 81 in FIG. 4B. In this case, electric conduction can be achieved without use of a method such as wire bonding.

Figure 5B:
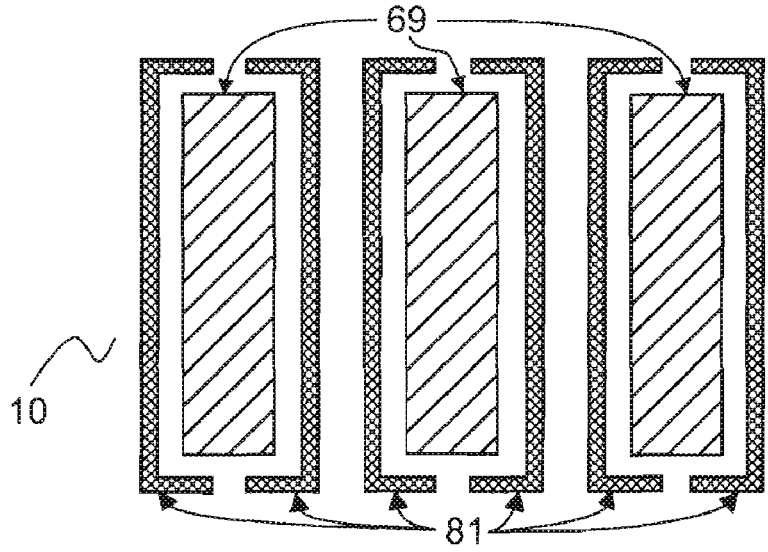

As shown in FIG. 5B, an area in which the groove 81 is not provided can be disposed in a portion of the groove 81 in FIG. 4C. In this case, the stress applied to the material pressing body 69 is alleviated. The crosstalk from the adjacent material pressing body 69 can be suppressed. Furthermore, electrical conduction can be achieved without use of a method such as wire bonding. The groove 81 on the short end side and the groove 81 on the long end side can be disposed in positions separated from each other. The area in which the groove 81 is not provided is not particularly limited. The area can be disposed in an arbitrary position.

In the variation example described above, a recess can be used in place of the groove 81. The recess refers to a section that recesses from the surface of the substrate 10. In this case, the recesses can be individually formed. Alternatively, the recesses can be connected. Furthermore, both the groove 8 and the recess can be combined, such as the groove 81 being disposed in one section and the recess being disposed in the remaining sections.

The positions and the depths of the grooves and recesses that are formed are not limited to the examples. For example, the grooves 81 and the recesses can be formed to have half the thickness of the substrate 10 or more, as shown in FIG. 1B. As a result, the influence (crosstalk) on the droplet discharging operations of adjacent cavities can be efficiently suppressed.

First Embodiment

Piezoelectric Linear Motor

Figure 6A:
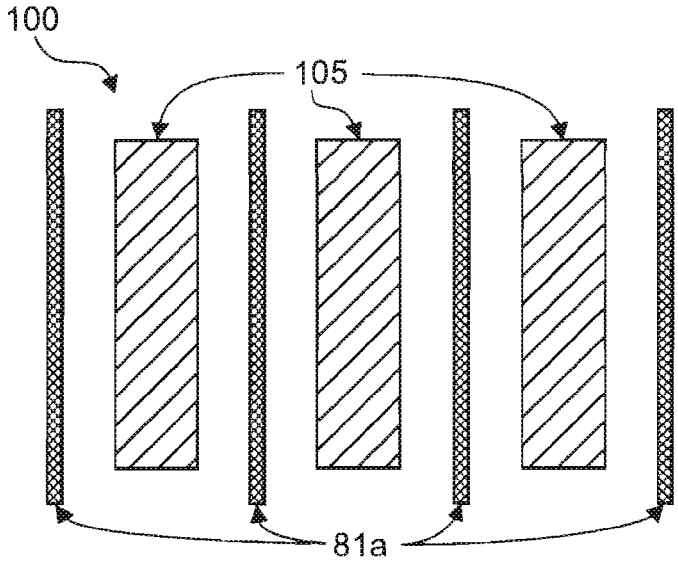
FIG. 6A is a plan view of a piezoelectric linear motor.
Figure 6B:
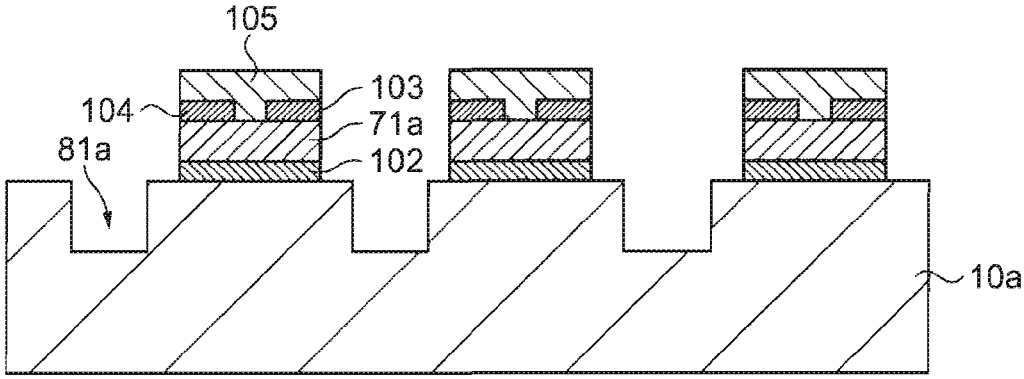
FIG. 6B is a cross-sectional view of the piezoelectric linear motor.
Figure 7A:
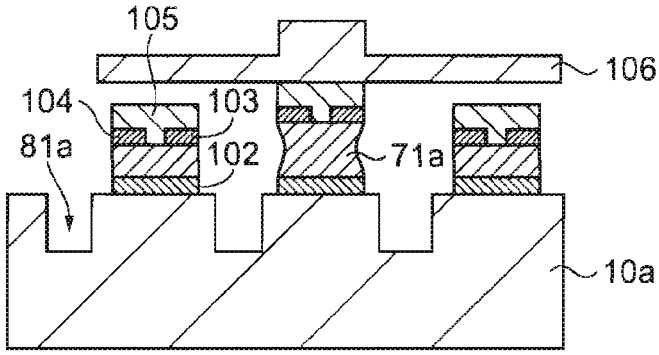
FIG. 7A to FIG. 7D are cross-sectional views explaining operating principles of the piezoelectric linear motor.

Hereafter, an energy converting element and a piezoelectric linear motor serving as a piezoelectric device according to a first embodiment will be described with reference to the drawings. FIG. 6A is a plan view of a piezoelectric linear motor 100. FIG. 6B is a cross-sectional view of the piezoelectric linear motor 100. A sample 106 shown in FIG. 7A is transported along a direction cutting across a protective layer 105.

A configuration of the piezoelectric linear motor 100 will be described below, with reference to FIG. 6B. The piezoelectric linear motor 100 includes a substrate 10*a*, a groove 81*a*, an electrode 102, a piezoelectric thin film 71*a* serving as an energy converting section, an electrode 103, an electrode 104, and a protective layer 105.

The electrode 102, the piezoelectric thin film 71*a*, the electrode 103, the electrode 104, and the protective layer 105 are sequentially disposed on the substrate 10*a*. The substrate 10*a* can be, for example, a silicon substrate.

Next, operating principles of the piezoelectric linear motor 100 will be described with reference to FIG. 7A to FIG. 7D.

First, as shown in FIG. 7A, when voltage (electric power) is applied between the electrode 102 and the electrode 103, and between the electrode 102 and the electrode 104, the piezoelectric thin film 71*a* becomes deformed in a vertical direction. Here, when the voltage (electric power) is applied under conditions in which the piezoelectric thin film 71*a* extends in an upward direction, the sample 106 is lifted upwards via the protective layer 105, by the piezoelectric thin film 71*a* to which the voltage is applied. The sample 106 separates from the protective layers 105 on the other piezoelectric thin layers 71*a* to which the voltage is not applied.

Figure 7B:
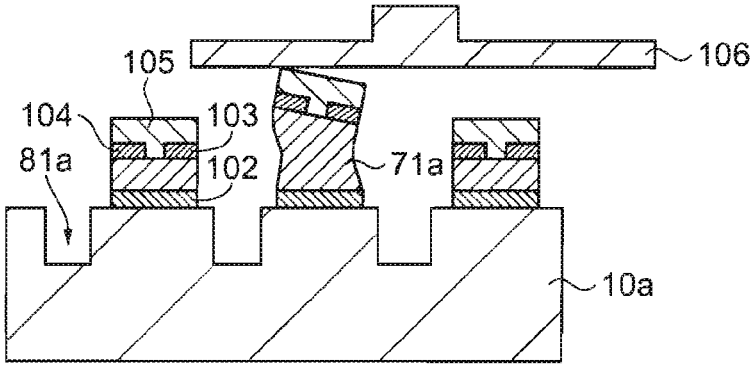

Next, as shown in FIG. 7B, when a higher voltage (electric power) is applied to the electrode 103 to which the above-described voltage is applied in this state, the piezoelectric thin film 71*a* becomes deformed in a horizontal direction. Here, when the voltage (electric power) is applied to the electrode 103 to which the above-described voltage is applied under conditions in which the piezoelectric thin film 71 becomes deformed (bends) in the right-hand direction, the sample 106 moves to a right-hand side oft the original position.

Figure 7C:
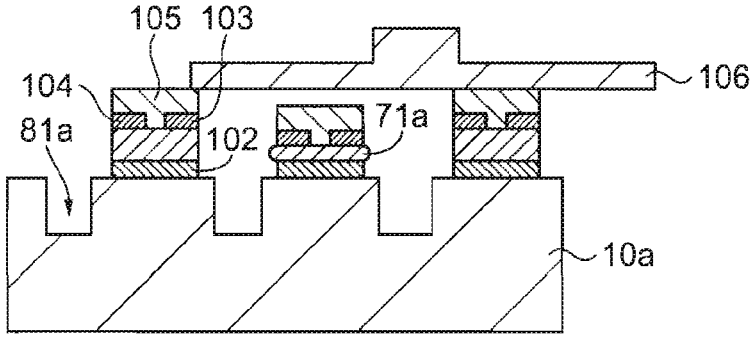

Next, as shown in FIG. 7C, when voltage is applied between the electrode 102 and the electrode 103, and between the electrode 102 and the electrode 104 in this state, under conditions in which the piezoelectric thin film 71*a* contracts, the protective layer 105 on the piezoelectric thin film 71*a* to which the voltage is applied separates in a state in which the sample 106 is transported in the right-hand direction.

Figure 7D:
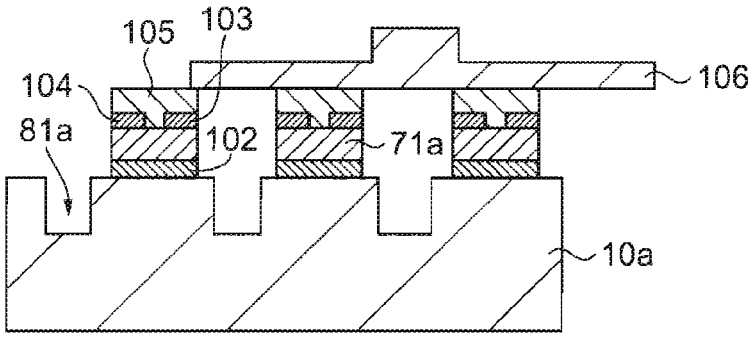

Next, as shown in FIG. 7D, when the application of voltage between the electrode 102, the electrode 103, and the electrode 104 stops, the piezoelectric linear motor 100 returns to an initial state, aside from the sample 106 being shifted in the right-hand direction.

The sample 106 can be transported by this operation being repeated. In this case, the amount of deformation in the horizontal direction depends on the voltage (electric power) applied between the electrode 102 and the electrode 103, between the electrode 102 and the electrode 104, and between the electrode 103 and the electrode 104. Therefore, the sample 106 can be moved at a high speed by an increase in the applied voltage (electric power) being applied between the electrode 102 and the electrode 103.

Next, an operation of the groove 81*a* will be described. When voltage (electric power) is applied between the electrode 102 and the electrode 103, the piezoelectric thin film 7*a* becomes deformed in the vertical direction. Displacement that is the deformation multiplied by Poisson's ratio occurs in a direction parallel to the substrate 10*a*. When the displacement is stopped at the substrate 10*a*, stress fatigue occurs at an interface between the piezoelectric thin film 71*a* and the substrate 10*a*, in particular. Life characteristics of the piezoelectric linear motor are deteriorated.

In this way, the groove 81*a* is disposed and the stress applied to the piezoelectric thin film 71*a* is alleviated. As a result, the life characteristics of the piezoelectric linear motor 100 can be improved. Displacement in the horizontal direction can be increased. As a result, transport amount and transport speed of the piezoelectric linear motor 100 can be improved.

When a distance between an edge of the groove 81*a* at a side adjacent to the piezoelectric thin film 71*a* serving as the energy converter and an edge of the piezoelectric thin film 71*a* at a side adjacent to the groove 81*a* is x (micrometers) and a depth of the groove 81*a* is d (micrometers), a shape within a range meeting the following expressions is preferable.

$$0.2d(-4.6x+42.8)\geqq 1 \quad \text{(Relational Expression 4)}$$

$$0.2d(-4.6x+42.8)\geqq 5 \quad \text{(Relational Expression 5)}$$

When the Relational Expression 4 is met, 1% or more of the shear stress can be released. A piezoelectric linear motor 100 that can perform detection of a more significant amount can be formed because of the presence of the groove 81*a*.

When the Relational Expression 5 is met, 5% or more oaf the shear stress can be released. A piezoelectric motor 100 having a long service life and operating with low power consumption can be formed because of the presence of the groove 81*a*.

The groove 81*a* is preferably separated from the piezoelectric thin film 71*a* by 1 micrometer or more. The depth of the groove 81*a* is preferably 10 micrometers or less. In this case, the groove 81*a* can be disposed without degrading the reliability of the piezoelectric thin film 71*a*.

The groove 81*a* can be filled with a material having a lower Young's modulus than the substrate 10*a*. For example, the groove 81*a* can be filled with porous silicon oxide. In this case, the groove 81*a* is sealed. Permeation of particle-shaped materials and gases smaller than the width of the groove 81*a* can be suppressed. Because the Young's modulus is low, the operation of the piezoelectric thin film 71*a* is not inhibited. Mechanical and chemical deterioration does not easily occur. The reliability of the piezoelectric linear motor 100 can be enhanced.

A recess section can be used in place of the groove 81*a*. In this case, the recess sections can be individually formed. Alternatively, the recess sections can be connected. Furthermore, both the groove 81*a* and the recess section can be combined, such as the groove 81*a* being disposed in one section and the recess section being disposed in the remaining sections.

The groove 81*a* that is longer than the piezoelectric thin film 71*a* is disposed between the piezoelectric thin film 71*a* and an adjacent piezoelectric thin film 71*a*. However, a configuration that is similar to the configuration described in Variation Example: Example of Groove Configuration can also be used instead.

Second Embodiment

Cantilever Actuator

Figure 8A:
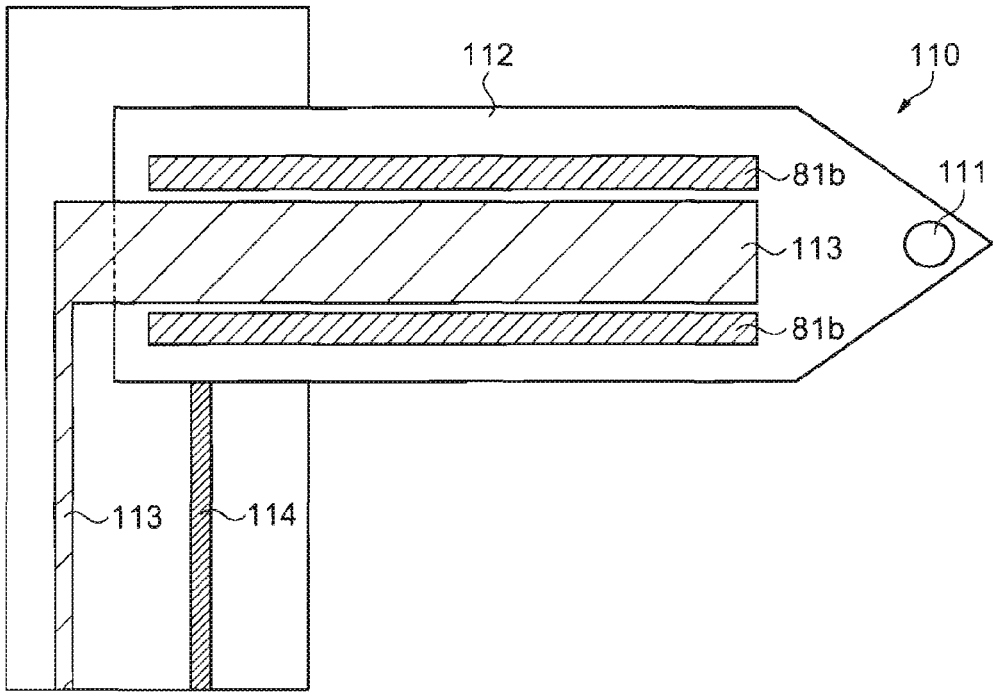
FIG. 8A is a bottom view of a cantilever actuator.
Figure 8B:
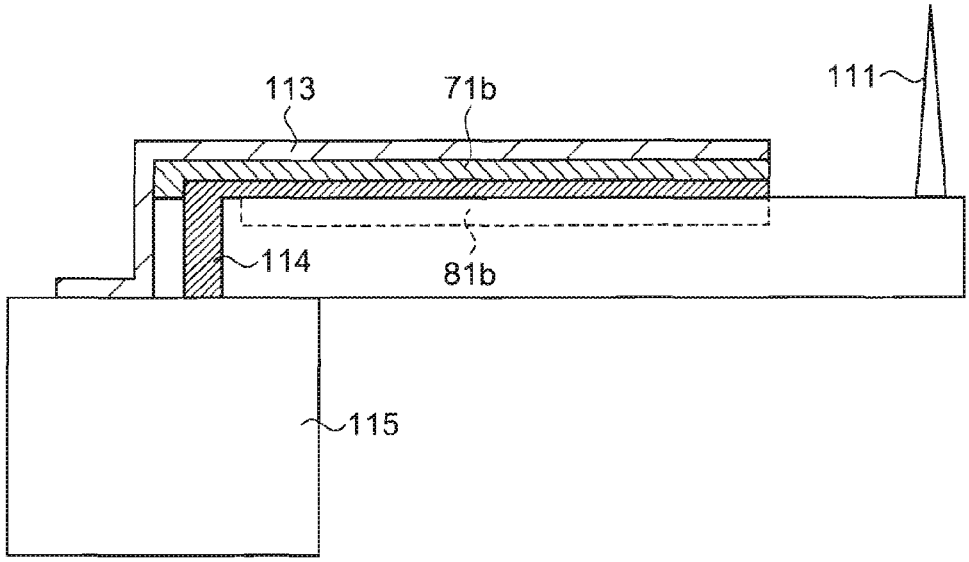
FIG. 8B is a side view of the cantilever actuator.

A cantilever actuator serving as an energy converting element according to a second embodiment will be described below,d with reference to the drawings. FIG. 8A is a bottom view of a cantilever actuator 110. FIG. 8B is a side view of the cantilever actuator 110. The cantilever actuator 110 includes a probe 111, an arm 112, a piezoelectric thin film 71*b*, an electrode 113, an electrode 114, a base 115, and a groove 81*b*.

The piezoelectric thin film 71*b* is set on the arm 112 supported by the base 115. When voltage (electric power) is applied to the piezoelectric thin film 71*b* via the electrode 113 and the electrode 114, the arm 112 moves in the vertical direction. The probe 111 can be displaced by a minute amount. Because the groove 81*b* is provided, stress applied to the piezoelectric thin film 71*b* is released by deformation of the groove 81*b*. As a result, a cantilever actuator 110 that can suppress deterioration caused by internal stress can be provided. Regarding the disposal of the groove 81*b*, conditions under which the disposal of the groove 81*b* is determined, and the like, those in the variation example and according to the first embodiment can be used.

A recess section can be used in place of the groove 81*b*. In this case, the recess sections can be individually formed. Alternatively, the recess sections can be connected. Furthermore, both the groove 81*b* and the recess section can be combined, such as the groove 81*b* being disposed in one section and the recess section being disposed in the remaining sections.

Third Embodiment

Piezoelectric Sensor

A piezoelectric sensor serving as an energy converting element according to a third embodiment will be described below. The piezoelectric sensor is an energy converting element that converts energy inputted as pressure into electric power.

Figure 9A:
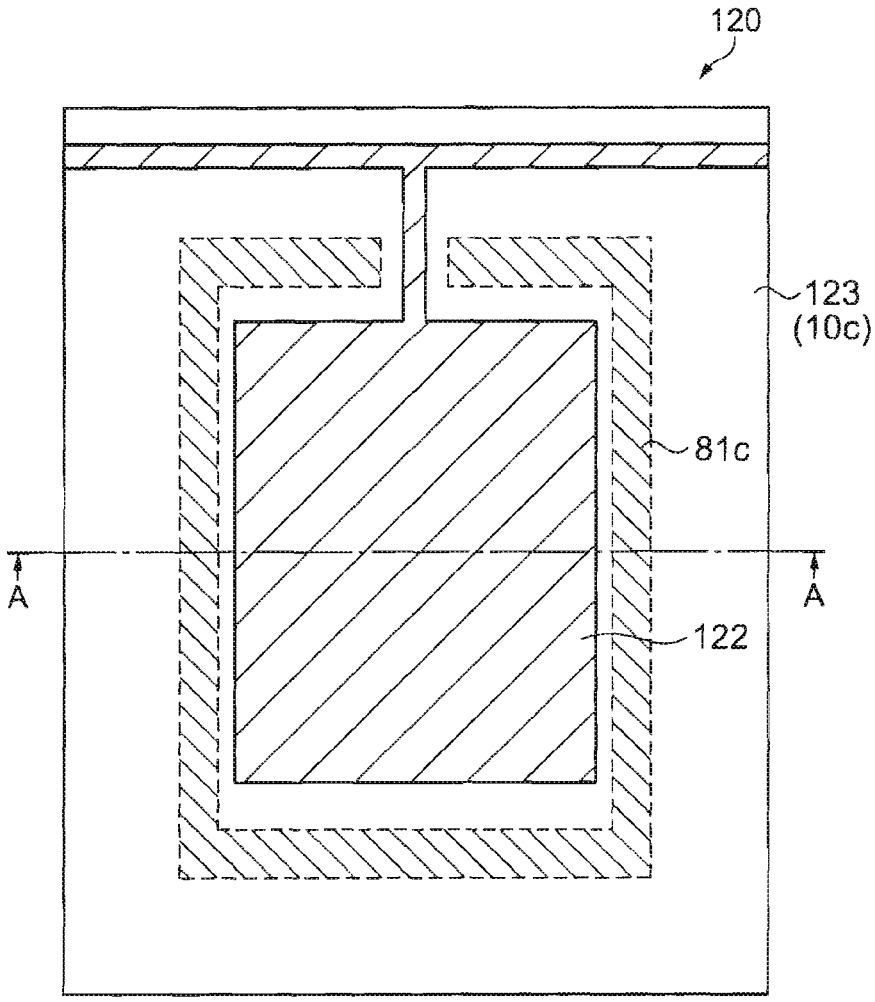
FIG. 9A is a plan view of a piezoelectric sensor.
Figure 9B:
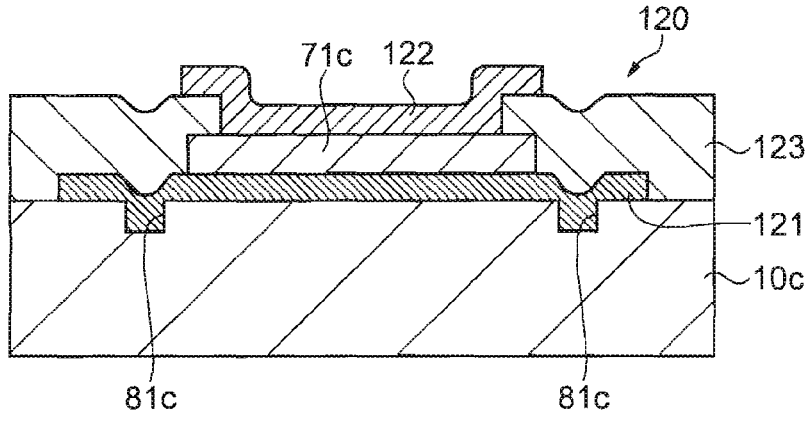
FIG. 9B is a cross-sectional view of the piezoelectric sensor.

FIG. 9A is a plan view of a piezoelectric sensor 120. FIG. 9B is a cross-sectional view. The piezoelectric sensor 120 shown in FIG. 9A includes a substrate 10*c*, a piezoelectric thin film 71*c*, an electrode 121, an electrode 122, a groove 81*c*, and an insulating film 123.

Next, a configuration will be described with reference to FIG. 9B. The electrode 121 is disposed on the substrate 10*c*. The insulating film 123 is disposed on the electrode 121. The insulating film 123 is not disposed in an area in which the piezoelectric thin film 71*c* is provided. The electrode 121 and the piezoelectric thin film 71*c* are in direct contact. The electrode 122 is disposed on the piezoelectric thin film 71*c*.

When stress is applied to the piezoelectric thin film 71*c*, the piezoelectric thin film 71*c* outputs a voltage (electric power) correlating with an amount of distortion caused by the stress. Compared to when the groove 81*c* is not provided, piezoelectric thin film 71*c* can become easily deformed because of the presence of the groove 81*c*. Therefore, a highly sensitive piezoelectric sensor 120 can be provided.

Regarding the disposal of the groove 81*c*, conditions under which the disposal of the groove 81*c* is determined, and the like, those in the variation example and according to the first embodiment can be used.

A recess section can be used in place of the groove 81*c*. In this case, the recess sections can be individually formed. Alternatively, the recess sections can be connected. Furthermore, both the groove 81*c* and the recess section can be combined, such as the groove 81*c* being disposed in one section and the recess section being disposed in the remaining sections.

The electrode 121 is disposed in the groove 81*c* according to the embodiment. The electrode 121 is preferably made of a material having a lower Young's modulus than the substrate 10*c*. A configuration in which nothing is disposed in the groove 81*c* can also be used.

Fourth Embodiment

Electrostatically Driven Ink-jet Head

An electrostatically driven ink-jet head serving as an energy converting element according to a fourth embodiment will be described below. Instead of the piezoelectric effect of the above-described piezoelectric thin film 71*a* (see FIG. 6B), for example, the electrostatically driven ink-jet head applies voltage between electrode and uses coulomb force generated between the electrodes to convert voltage (electric power) to bending. As a result, ink is externally discharged.

Figure 10A:
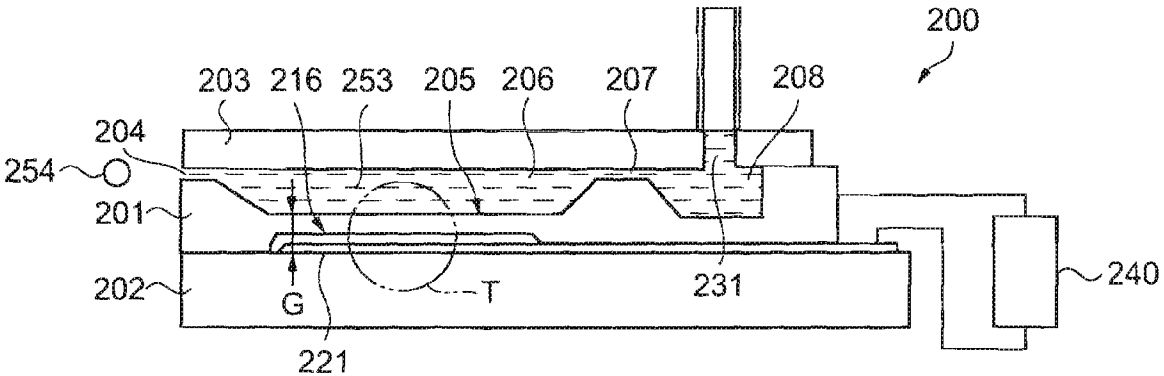
FIG. 10A is a cross-sectional view of an electrostatically driven ink-jet head.
Figure 10B:
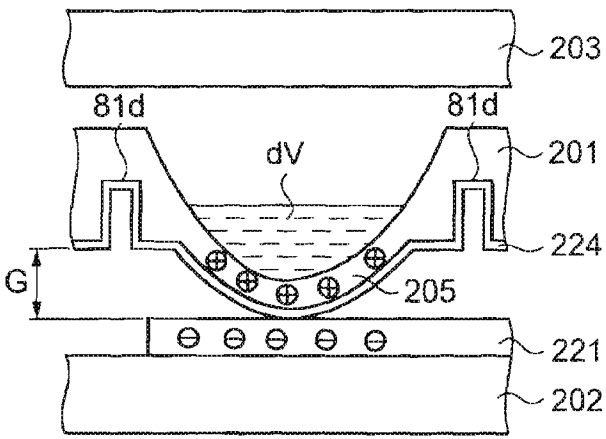
FIG. 10B is an enlarged view of a the electrostatically driven ink-jet head.

FIG. 10A is a cross-sectional view of an electrostatically driven ink-jet head 200. FIG. 10B is an enlarged view of an area of the electrostatically driven ink-jet head 200, indicated by T. The electrostatically driven ink-jet head 200 includes a first substrate 201, a second substrate 202, a third substrate 203, a nozzle hole 204, a vibrating plate 205, a discharging chamber 206, an orifice 207, an ink collecting section 208, a gap section 216, an electrode 221, an insulating film 224, an ink supply opening 231, ink 253, a drive circuit 240, an ink droplet 254, and a groove 81*d*.

The first substrate 201 is a silicon substrate. The vibrating plate 205 is disposed on the first substrate 201. The insulating film 224 is disposed under the vibrating plate 205 (on the second substrate 202 side). The insulating film 224 prevents an electrical short circuit from occurring even when the vibrating plate 205 and the electrode 221 come into contact. Grooves 81*d* are formed in areas sandwiching the vibrating plate 205. The grooves 81*b* alleviate stress applied to the vibrating board 205. The vibrating plate 205 itself serves as an electrode. Alternatively, the vibrating plate 205 includes an electrode.

The nozzle hole 204 is disposed in an area sandwiched between the first substrate 201 and the third substrate 203. The nozzle hole 204 discharges the ink 253 as the ink droplet 254. The vibrating plate 205 becomes deformed and applies pressure to the ink 253 so that the ink 253 is discharged. The third substrate 203 can be borosilicate glass.

The orifice 207 supplies the ink 253 from the ink collecting section 208 to the ink supply opening 231.

The second substrate 202 can be borosilicate glass, as is the third substrate 203. The electrode 221 is disposed on the upper side of the second substrate 202 (on the first substrate 201 side). The electrode 221 supplies an electrical field to allow the vibrating plate 205 to become deformed.

The gap section 216 is disposed in an area sandwiched between the first substrate 201 and the second substrate 202. The gap section 216 is formed by the vibrating plate 205 and the electrode 221 and has a length G. Voltage (electric power) is applied to the vibrating plate 205 and the electrode 221 from the drive circuit 240. As a result, the vibrating plate 205 becomes deformed. The volume of the discharging chamber 2 changes. A discharge operation of the ink droplet 254 is controlled.

A basic mechanism of the discharge of the ink droplet 254 is described as follows. An appropriate voltage is applied from the drive circuit 240 to the electrode 221. When a surface of the electrode 221 becomes positively charged, a bottom surface of a corresponding vibrating plate 205 is negatively charged. Therefore, the vibrating plate 205 bends downward because of the Coulomb force (the second substrate 202 side). Next, when the voltage (electric power) applied to the electrode 221 is turned OFF, the vibrating plate 205 returns to its original shape as a result of the elasticity of the vibrating plate 205 itself. Therefore, pressure within the discharging chamber 206 suddenly increases. The ink droplet 254 is discharged from the nozzle hole 204. Next, the vibrating plate 205 bends downward again. The ink 253 is supplied within the discharging chamber 206 from the ink collecting section 208, through the orifice 207. When the groove 81*d* is provided near the vibrating plate 205, the stress applied to the vibrating plate 205 is released by the deformation of the groove 81*d*. Therefore, the volume of the discharging chamber 206 can change by a large amount. The amount of change in the volume of the discharging chamber 206 can be maintained even when the electrostatically driven ink-jet head 200 is reduced in size.

The stress applied to the vibrating plate 205 is released. Therefore, the stress applied to the vibrating plate 205 caused by the Coulomb force is released. As a result, the deterioration of the vibrating plate 205 can be suppressed. A highly reliable electrostatically driven ink-jet head 200 can be provided.

Regarding the disposal of the groove 81*d*, conditions under which the disposal of the groove 81*d* is determined, and the like, those in the variation example and according to the first example can be used.

A recess section can be used in place of the groove 81*d*. In this case, the recess sections can be individually formed. Alternatively, the recess sections can be connected. Furthermore, both the groove 81*d* and the recess section can be combined, such as the groove 81*d* being disposed in one section and the recess section being disposed in the remaining sections.

What is claimed is:

1. A droplet discharging head, comprising:

a substrate;

a cavity section formed by a first recess of a first surface side of the substrate;

a cover material disposed on a first surface of the substrate, the cover material having a discharge opening to discharge a part of liquid filled in the cavity section;

a movable plate disposed on the cavity section, the movable plate being disposed opposite to the cover material;

a material pressing body including a piezoelectric material sandwiched between a first electrode and a second electrode, the material pressing body being disposed on the movable plate;

at least one of a groove of the second surface side of the substrate and a second recess of the second surface side of the substrate; and a filler material having a lower Young's modulus than the substrate being disposed within the one of a groove of the second surface side of the substrate and a second recess of the second surface side of the substrate.

2. A droplet discharging head according to claim 1, the discharge opening being formed by a through-hole, and the one of a groove of the second surface side of the substrate and a second recess of the second surface side of the substrate being disposed in a direction extending along an edge of the piezoelectric material.

3. The droplet discharging head according to claim 2 satisfying a following formula:

$$0.2d(-4.6x+42.8)\geqq 1$$

wherein x (micrometer unit) is a distance between an edge of the piezoelectric material at a side adjacent to the one of a groove of the second surface side of the substrate and a second recess of the second surface side of the substrate and an edge of the one of a groove of the second surface side of the substrate and a second recess of the second surface side of the substrate at a side adjacent to the piezoelectric material, and d (micrometer unit) is a depth of the one of a groove of the second surface side of the substrate and a second recess of the second surface side of the substrate, wherein x is between 0 micrometers and 10 micrometers and d is between 0 micrometers and 10 micrometers.

4. The droplet discharging head according to claim 2 satisfying a following formula:

$$0.2d(-4.6x+42.8) \geqq 5$$

wherein x (micrometer unit) is a distance between an edge of the piezoelectric material at a side adjacent to the one of a groove of the second surface side of the substrate and a second recess of the second surface side of the substrate and an edge of the one of a groove of the second surface side of the substrate and a second recess of the second surface side of the substrate at a side adjacent to the piezoelectric material, and d (micrometer unit) is a depth of the one of a groove of the second surface side of the substrate and a second recess of the second surface side of the substrate, wherein x is between 0 micrometers and 10 micrometers and d is between 0 micrometers and 10 micrometers.

5. The droplet discharging head according to claim 2, a distance between an edge of the piezoelectric material at a side adjacent to the one of a groove of the second surface side of the substrate and a second recess of the second surface side of the substrate and an edge of the one of a groove of the second surface side of the substrate and a second recess of the second surface side of the substrate at a side adjacent to the piezoelectric material is 1 micrometer.

6. The droplet discharging head according to claim 2, a depth of the one of a groove of the second surface side of the substrate and a second recess of the second surface side of the substrate being 10 micrometers or less.

7. The droplet discharging head according to claim 1, the substrate including silicon.

8. The droplet discharging head according to claim 1, the filler material including porous silicon oxide.

9. The droplet discharging head according to claim 1, the movable plate positioned on the second surface side of the substrate.

10. The droplet discharging head according to claim 1, the movable plate including a portion of the substrate.

11. A microelectro mechanical system, comprising:

a substrate;

a cavity section;

a movable section provided on the cavity section, the movable section being disposed on a first surface of the substrate or disposed at a first surface side of the substrate;

at least one of a groove of the first surface side of the substrate and a recess of the first surface side of the substrate; and a filler material having a lower Young's modulus than the substrate being disposed within the one of a groove of the first surface side of the substrate and a recess of the first surface side of the substrate.

* * * * *